US007134977B2

(12) United States Patent
Campbell et al.

(10) Patent No.: US 7,134,977 B2
(45) Date of Patent: Nov. 14, 2006

(54) SPORTS TRAINING TARGET SYSTEM

(76) Inventors: Thomas J. Campbell, 600 Walker, Center, TX (US) 75935; Steven C. Campbell, 600 Walker, Center, TX (US) 75935

( * ) Notice: Subject to any disclaimer, the term of this patent is extended or adjusted under 35 U.S.C. 154(b) by 109 days.

(21) Appl. No.: 10/787,874

(22) Filed: Feb. 24, 2004

(65) Prior Publication Data

US 2005/0187037 A1 Aug. 25, 2005

(51) Int. Cl.
*A63B 69/00* (2006.01)
*F41J 5/14* (2006.01)

(52) U.S. Cl. ..... 473/454; 473/438; 273/392; 273/406

(58) Field of Classification Search ..... 273/398–402, 273/368, 390–392, 380, 406, 407, 454–456; 473/454–456, 438; 446/217, 218; 416/210 R, 416/41

See application file for complete search history.

(56) References Cited

U.S. PATENT DOCUMENTS

| | | | | | |
|---|---|---|---|---|---|
| 278,842 | A | * | 6/1883 | Wilcox | 416/16 |
| 1,488,647 | A | * | 4/1924 | Quinn | 273/368 |
| 1,507,296 | A | * | 9/1924 | Newman | 273/369 |
| 1,537,738 | A | * | 5/1925 | Bisbing | 273/390 |
| 2,179,471 | A | * | 11/1939 | Lee | 273/368 |
| 2,899,204 | A | * | 8/1959 | Ratay | 273/392 |
| 3,103,362 | A | * | 9/1963 | Elofson | 273/359 |
| 3,413,003 | A | * | 11/1968 | Bell | 273/408 |
| 3,552,749 | A | * | 1/1971 | Piggote | 473/448 |
| 3,814,429 | A | * | 6/1974 | Lienhard | 273/368 |
| 4,286,779 | A | * | 9/1981 | Collins | 273/402 |
| 4,295,648 | A | * | 10/1981 | Stromback | 473/456 |
| 4,635,943 | A | * | 1/1987 | Lumpkin | 273/402 |
| 4,781,376 | A | | 11/1988 | Barnes, Sr. | |
| 5,176,386 | A | * | 1/1993 | Simmons | 273/392 |
| 5,496,039 | A | * | 3/1996 | Zammuto | 273/368 |
| 5,573,240 | A | | 11/1996 | Humboldt | |
| 5,598,996 | A | * | 2/1997 | Rath | 248/163.1 |
| 5,632,491 | A | * | 5/1997 | Hamas | 273/407 |
| 5,676,378 | A | * | 10/1997 | West | 273/390 |
| 5,746,671 | A | | 5/1998 | Ritchie | |
| 5,803,841 | A | | 9/1998 | Daskoski | |
| 5,803,842 | A | | 9/1998 | Ross | |
| 5,967,523 | A | * | 10/1999 | Brownlee | 273/407 |
| 6,478,301 | B1 | * | 11/2002 | Witmeyer | 273/391 |
| 6,620,065 | B1 | | 9/2003 | Clabough | |
| 6,994,348 | B1 | * | 2/2006 | Lambert et al. | 273/406 |
| 6,994,349 | B1 | * | 2/2006 | Lambert et al. | 273/406 |

FOREIGN PATENT DOCUMENTS

| | | | |
|---|---|---|---|
| SU | 408711 | * | 2/1966 |

* cited by examiner

*Primary Examiner*—Mark S. Graham
(74) *Attorney, Agent, or Firm*—Gregory M. Hasley; Akin Gump Strauss Hauer & Feld LLP

(57) ABSTRACT

A sports training target system is disclosed. The system includes a target anchor having a support post that includes a slight angle in the forward direction. The system includes a target section having at least one target arm which is rotatably secured to the anchor support post. When a ball is thrown by a pitcher and it strikes the target arm, the target section will partially rotate around the anchor support post. The angle in the support post, together with gravity, will force the taret section back to its original position facing the user.

18 Claims, 7 Drawing Sheets

SPORTS TRAINING TARGET SYSTEM

BACKGROUND OF THE INVENTION

1. Field of the Invention

This invention relates to a sports training system and, more particularly, to a practice target system and method for developing accurate throwing abilities for example, of a baseball by a baseball pitcher or football by a quarterback.

2. Description of the Related Art

In order to succeed in sports such as baseball and softball, a person typically must possess the ability to accurately throw a ball. Such an ability is particularly necessary for a pitcher in either of these sports. A pitcher must practice for many hours to develop and maintain accurate throwing abilities.

The traditional method of practicing pitching techniques requires both a pitcher and a catcher. The pitcher throws the ball to the catcher who provides a target with his mitt. This method of training can be successful, but it may be difficult for a pitcher to find second player with adequate skills to assist with the training. This severely limits when the pitcher can practice and for how much time he can practice. In addition, this method of practicing pitching lacks accuracy since it requires the catcher to make a subjective determination about whether or not the ball passed within the strike zone while at the same time attempting to catch a ball traveling at a high velocity. Accordingly, there is a need for a device which can allow a pitcher to practice pitching techniques without the aid of another player that can give the pitcher accurate feedback as to his proficiency level.

Once the pitcher's skills becomes more adept, the pitcher must practice not only pitching the ball within the strike zone, but also pitching the ball within a specific section of the strike zone. For example, the pitcher may want to fine tune his or her skills by practicing throwing pitches that are low and inside. Consequently, there is a need for a device which will allow a pitcher to target points within the strike zone so that he can fine tune his pitching skills.

In order to become a proficient pitcher, a player must also practice for many hours. The tedium of repetitive throwing can be particularly difficult to younger players who are just beginning to learn to pitch. It would be desirable to have an apparatus that can keep a player's interest focused on pitching at the target.

Pitchers can be trained wherever there is adequate open space to throw the ball. Training can occur at a baseball field, an empty lot, or even in a backyard. Ideally, a system for training pitchers should be lightweight, yet sturdy, and collapsible for easy transportation and storage.

Many practice targets are limited to a single sport. As a result, the targets can go unused for much of the year. It would be an advantage if a training target system could be used for a variety of sports. For example, similar type of repetitive training and accuracy requirements exist for football quarterbacks as for baseball pitchers. Additionally, target practice for shooting fire arms requires aiming practice to improve firing accuracy. It would be preferable if a sports training target system could be adapted to multiple sports.

For the above reasons, targets which allow a pitcher to practice throwing a ball have been proposed in the related art. Typical examples of training systems of the prior art can be found in U.S. Pat. Nos. 5,803,841 and 5,803,842. However, none of these prior art pitching targets achieve the advantages of the present invention.

BRIEF SUMMARY OF THE INVENTION

The present invention is a sports training target system. The system includes a target anchor that has an anchor base and a support post which extends upwardly from the anchor base at a slight angle in the forward direction. A target section having at least one target arm is rotatably attached to the anchor support post. When a pitcher or quarterback throws and strikes the target arm, the target section will rotate at least partially around the anchor support post. The angle in the support post, together with gravity, will force the target section to rotate back to its original position facing the pitcher or quarterback.

Preferably, the target section has four target arms extending outwardly from a center hub such that the target arms define the four corners of a batter's strike zone and has a figure of a catcher with a mit in between. Preferably, breakable disks, such as clay skeet disks, are removably attached to the outer portion of the target arms. Therefore, when a pitcher aims directly at the target disk, a successful pitch will result in a broken disk and a rotating target section.

Alternative embodiments of the present invention include target sections for football or firearms training. A target section for football may include a figure of a receiver for catching and may have different positioning on the target arms. A target section for firearms training may include figures of game animals on the target arms.

The features of the various embodiments of the present system can be used to train the user to locate their throws or shots at specific locations. The system also forces concentration on every throw or shot to hit and rotate the target. All ages and ability levels practice longer and with more intensity, when breakable targets are incorporated with a trainer to add to the experience.

DETAILED DESCRIPTION OF THE INVENTION

The components of the sports training target system of the present invention can be best understood in connection with a review of the attached figures. Referring to FIGS. 1–7, the sports training target system includes a target which allows the user to train by throwing or shooting at a particular spot.

Figure 1:
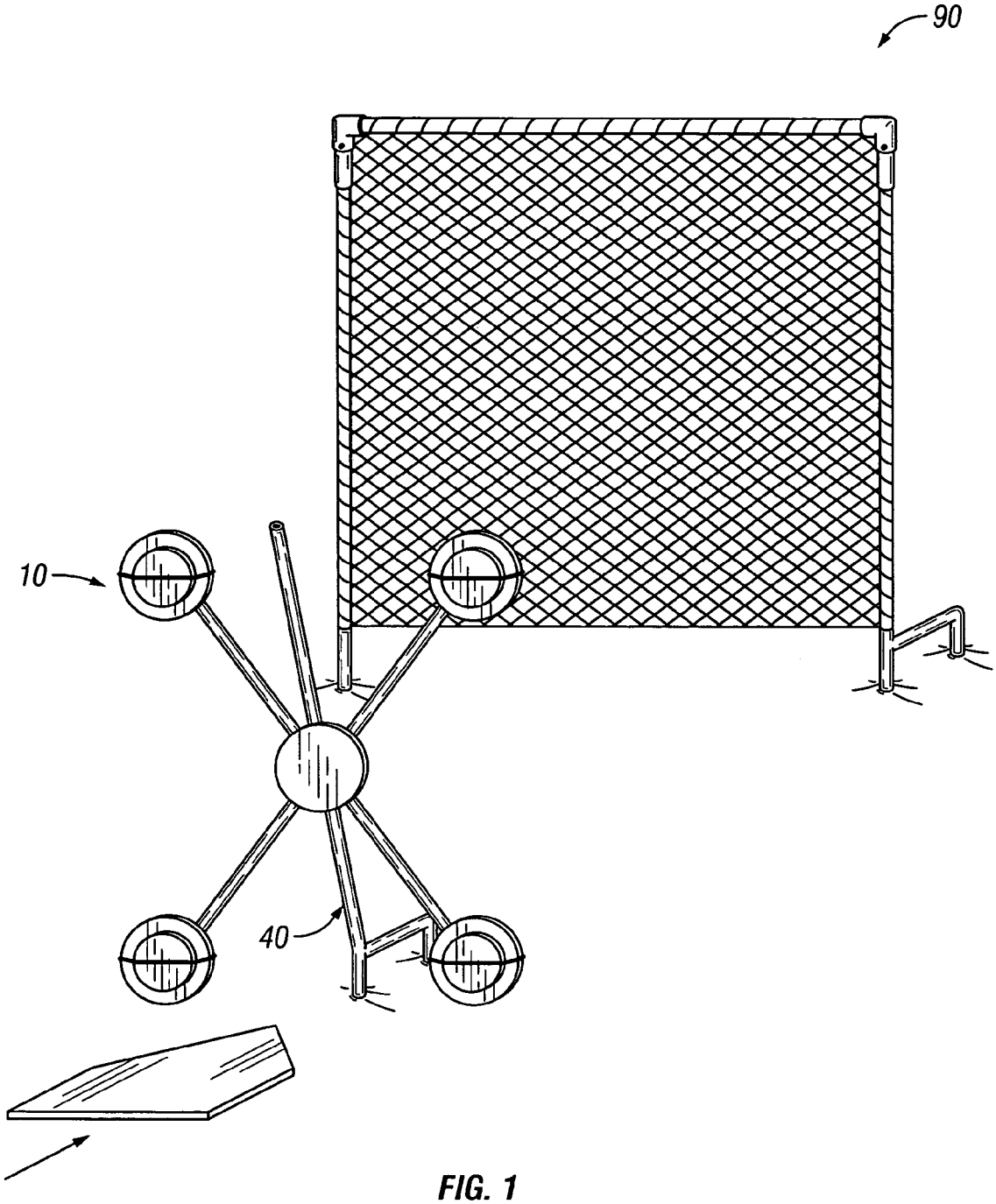
FIG. 1 is a perspective view of a sports training target system according to a first embodiment of the present invention.

Referring to FIG. 1, a sports training target system is disclosed. The sports target system of FIG. 1 is discussed here in terms of use by a baseball pitcher, however, this system can be used for other sports such as football or firearms practice, as is or with modifications discussed herein. A pitching target comprising a target anchor 40 and a target section 10 is assembled to face a pitcher. A pitcher (not shown) throws the ball toward the target plates 12, 14, 16, 18 on target section 10. Target section 10 is rotatably secured to target anchor 40 such that if the pitcher throws a ball and hits a target plate 12, 14, 16, 18, the target section will rotate in the direction the ball is moving. Preferably, target disks 20 can be placed over the target plates and removably secured there. It is believed that attaching breakable disks will increase the interest level and therefore the focus of the pitcher. Preferably, a collapsible and portable backstop 90 is positioned behind the target to stop balls which pass by the target.

Figure 2:
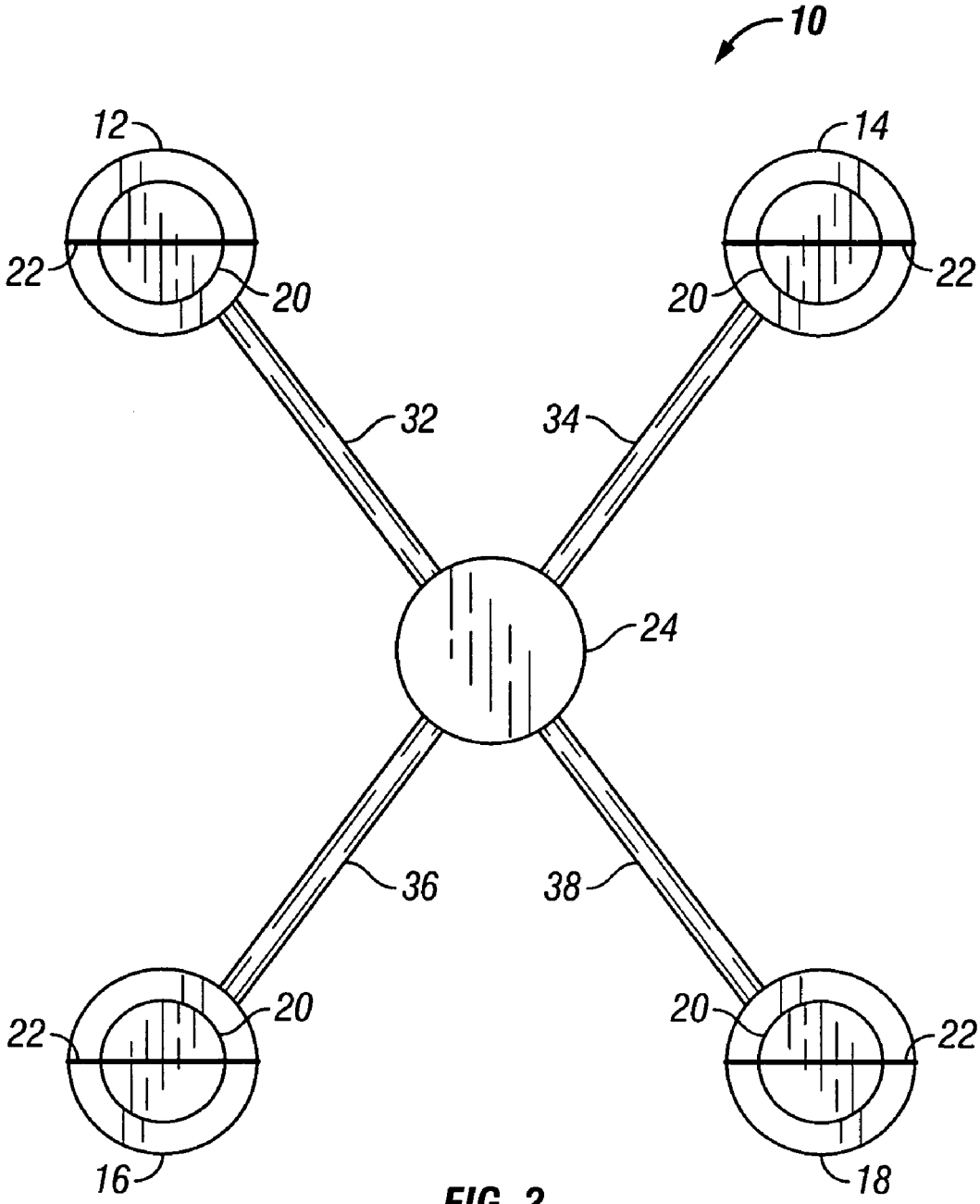
FIG. 2 is front view of a target section of an embodiment of the present invention.

Referring to FIG. 2, an embodiment of the target section of the present invention is shown. In this embodiment, the target section includes a center hub 24 and target arms comprising extension bars 32, 34, 36, and 38 and target plates 12, 14, 16, and 18. In the embodiment of FIG. 2, the target section contains four target arms. In this embodiment, the target plates define the four corners of a batter's strike zone. However, a target section may be composed of fewer or more target arms. A target section could comprise simply a single target arm.

A traditional home plate in baseball is seventeen inches wide, and this defines the approximate width of the strike zone. In this most preferred embodiment for use with baseball pitchers, target plates 16 and 18 are positioned to have centers approximately seventeen inches apart. Similarly, target plates 12 and 14 are positioned to have centers approximately seventeen inches apart. In this most preferred embodiment, disks 12 and 16 are positioned approximately twenty-two inches apart, as are disks 14 and 18. This approximates a strike zone for a batter of about twenty-two inches in height.

Preferably, center hub 24 and target plates 12, 14, 16, and 18 are made from steel plate and are cut in circular configurations of approximately four and one quarter inches in diameter. The target plates are preferably welded to the extension arms 32, 34, 36 and 38 such that approximately one inch of the bar extends onto the back side of the target plate. However, the plates may be removeably secure to the extension arms if desired. Target plates 12, 14, 16, and 18 are shown as round circular plates in FIG. 2. However, it should be recognized that these target plates can be of any number of various shapes and configurations. For example, when the target section is intended for use for firearms practice, the target plates may be shaped as turkeys or other game animals. Preferably, target plates 12, 14, 16, and 18 can be painted orange, such that they stand out for some distance.

Preferably, breakable disks 20 are attached to the forward facing portion of target plates 12, 14, 16, and 18 such that they face toward the pitcher. Breakable disks can be attached to the target plates using bands 22. Bands 22 can be a variety of elastic type bands or other means of attachment including clips, ties, brackets, or other attachment mechanisms such as are known to persons of skill in the art.

Breakable disks 20 are preferably clay disks such as the skeet used in firearm shooting practice. However, target disks 20 are not limited to clay disks, but can be made from other materials that would break upon contact with a fast-moving ball. Similarly, although disks 20 are shown to be circular, there is no limitation on the shape or configuration of the target disks.

In a most preferred embodiment of the training system for use with baseball, a figure (not shown) of a catcher holding an upward mitt may be positioned over center hub 24 between the target plates. This catcher figure more closely simulates the actual conditions of pitching practice. Similarly, a figure of a wide receiver can be used in embodiment for training quarterbacks to throw footballs.

Figure 3:
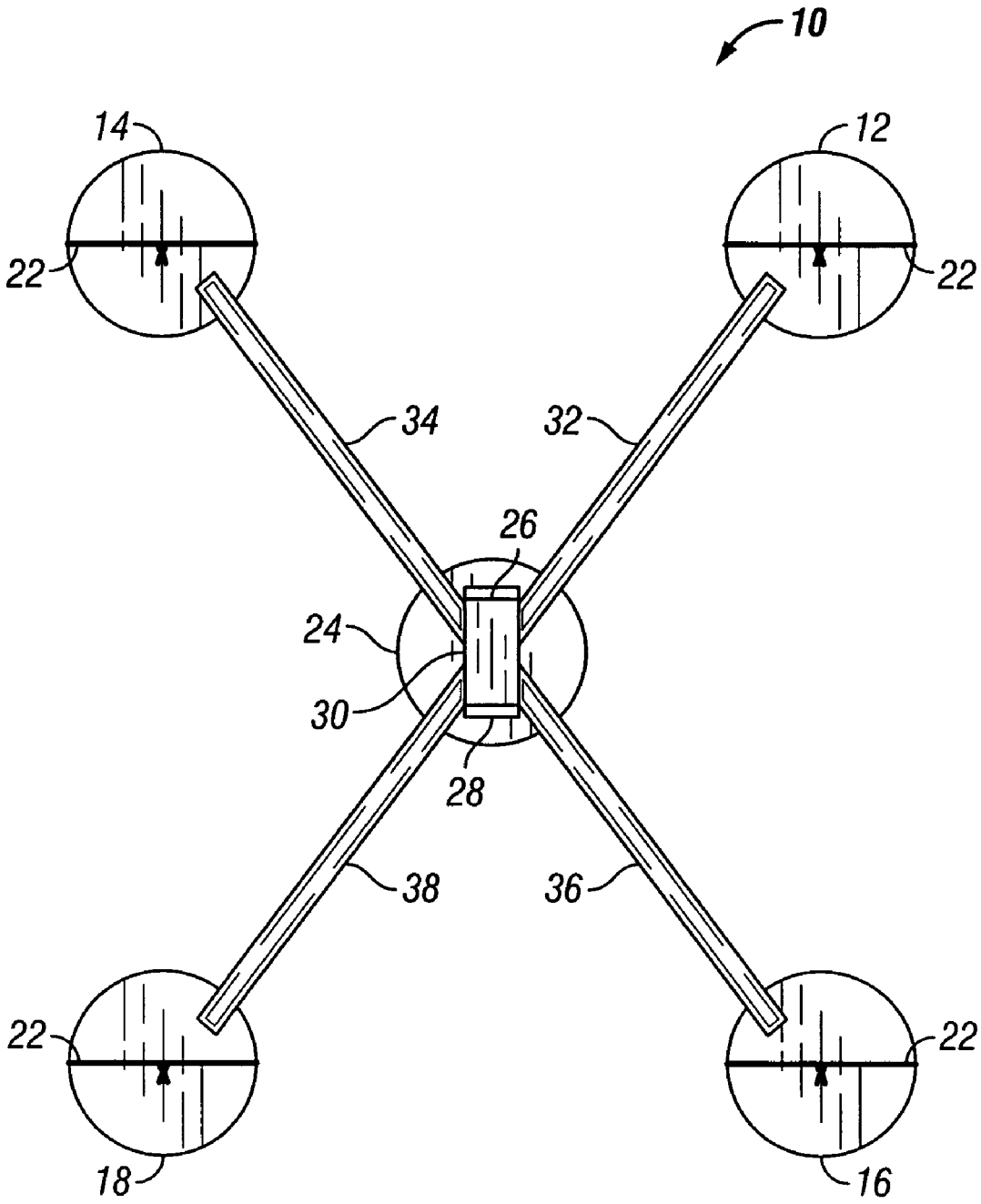
FIG. 3 is rear view of the target section of the embodiment of FIG. 2.

Referring to FIG. 3, a rear view of the target section 10 of an embodiment of the present invention is shown. A securing sleeve 30 is affixed to the back side of center hub 24. Securing sleeve 30 in the most preferred embodiment comprises a pipe nipple, approximately 3 inches long and made from 1¼" pipe. Bearings (not shown) of approximately ¾" internal diameter can be placed inside securing sleeve 30, preferably attached by a forced fit. End caps 26 and 28 can be attached to the outside of securing sleeve to insulate the bearings from the weather. End caps 26, 28 can be simply washers or other type of simple covers. Extension arms 32, 34, 36, and 38 are secured, preferably by welding, to the back side of center hub 24 on opposing sides of the securing sleeve 30. Preferably, extension arms are made of round steel bar of approximately ¾" in diameter. However, other sizes, shapes and materials can be used.

Figure 4:
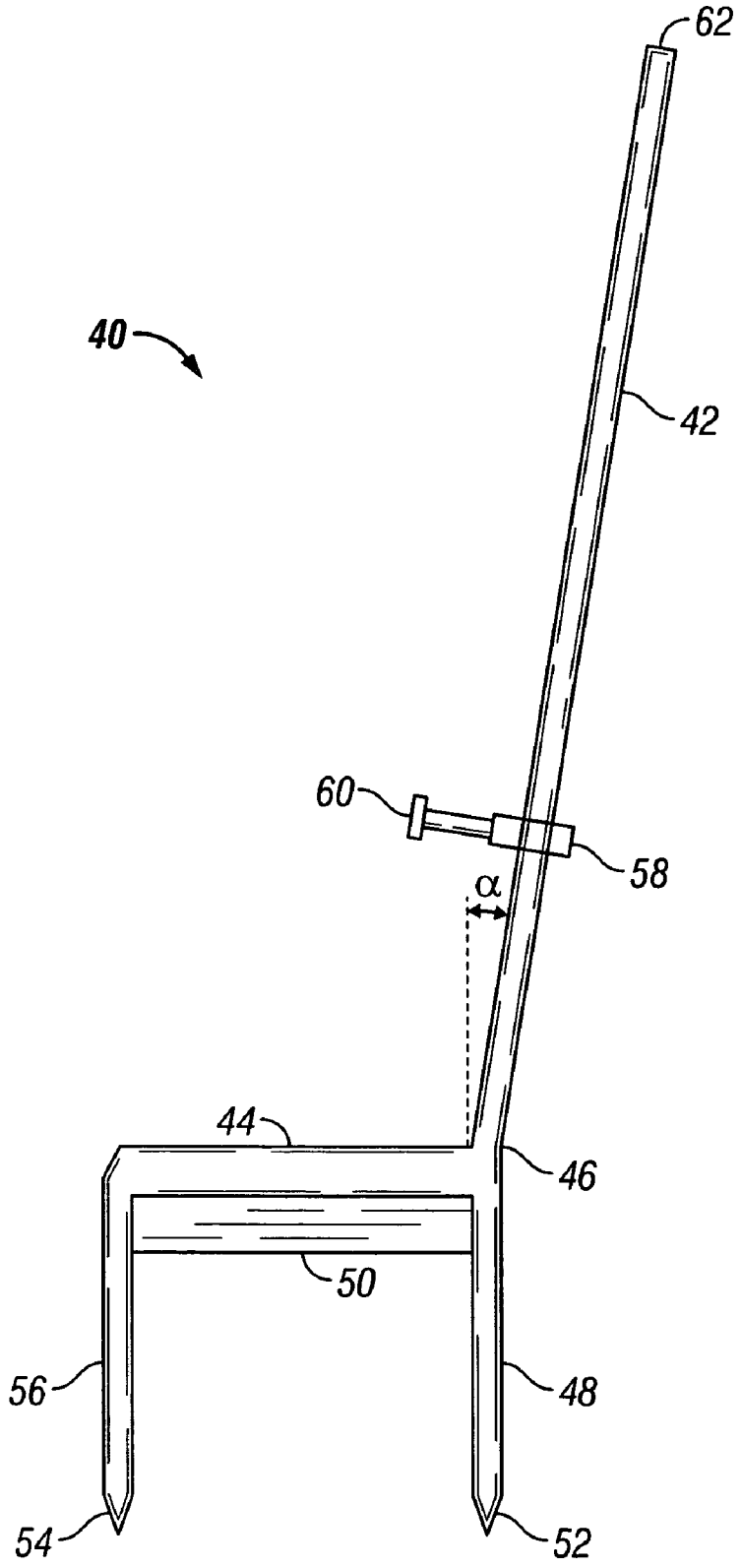
FIG. 4 is a side view of an embodiment of a target anchor base.

Referring to FIG. 4, an embodiment of a target anchor 40 is shown. In this embodiment, the target anchor comprises a support post 42, an installation bar 44, and stake portions 48 and 56. Each of these pieces of the target anchor are made from three quarters inch round steel bar.

In a preferred method of manufacturing the target anchor 40, a two-foot section of three quarters inch bar is welded perpendicular to a four foot piece of round three quarters inch bar at approximately one foot from one end of the four foot bar. The two-foot section is then bent at ninety degrees in the middle, approximately one foot from the four foot bar. This forms the installation bar 44 and the back side stake 56. That portion of the round bar extending beyond installation bar 44 can then be bent to a slight angle $\alpha$. Preferably, the angle a is between two and ten degrees. More preferably, the angle $\alpha$ is between about four and about six degrees. That portion of the bar that extends beyond installation bar 44 becomes the support post 42 and the shorter portion becomes the forward stake 48. Stakes 48 and 56 can be sharpened to have a point 52, 54. In the most preferred embodiment, a stiffening plate 50 can be installed underneath the installation bar 44 between stakes 48 and 56 to give additional rigidity and durability to the anchor base.

Preferably, a height adjustment collar 58 is positioned around support post 42. Height adjustment collar 58 allows positioning of the target section 10 to accommodate players of different sizes and ages, from as small as Pee Wee league players up to the major league players. In a most preferred embodiment, the height adjustment collar 58 is a set collar containing a tightening bolt 60. Bolt 60 can be loosened to adjust the height and tightened to secure the target section 10 at the appropriate position. Additionally, bolt 60 can act as a bumper for the target section to prevent rotation of the target section beyond about 90° from the forward-facing position.

Installation of the target system begins with installation of the anchor base 10. The anchor base is positioned such that forward stake 48 and support post 42 are facing in the direction of where the thrower will be standing. Rear stake 56 is placed behind stake 48. Points 52 and 54 are placed in the ground, and one can step on installation bar 44 to push the anchor base into the ground for firm, secure anchoring during use. Height adjustment collar 58 is then set at appropriate position, and the securing sleeve 30 is then placed over the anchor support post 42 and lowered down onto the height adjustment collar 58. When in position, the target section 10 should be able to partially rotate around the anchor support post 42, but upon release, should rotate back to a position where the target plates face the pitcher as a result of the forward angle a on the bar and the configuration of the target arms.

Preferably, the target system further includes a backstop 90. Preferably, the backstop is collapsible and portable such that it can be picked up and moved to wherever the target is to be used.

Figure 5:
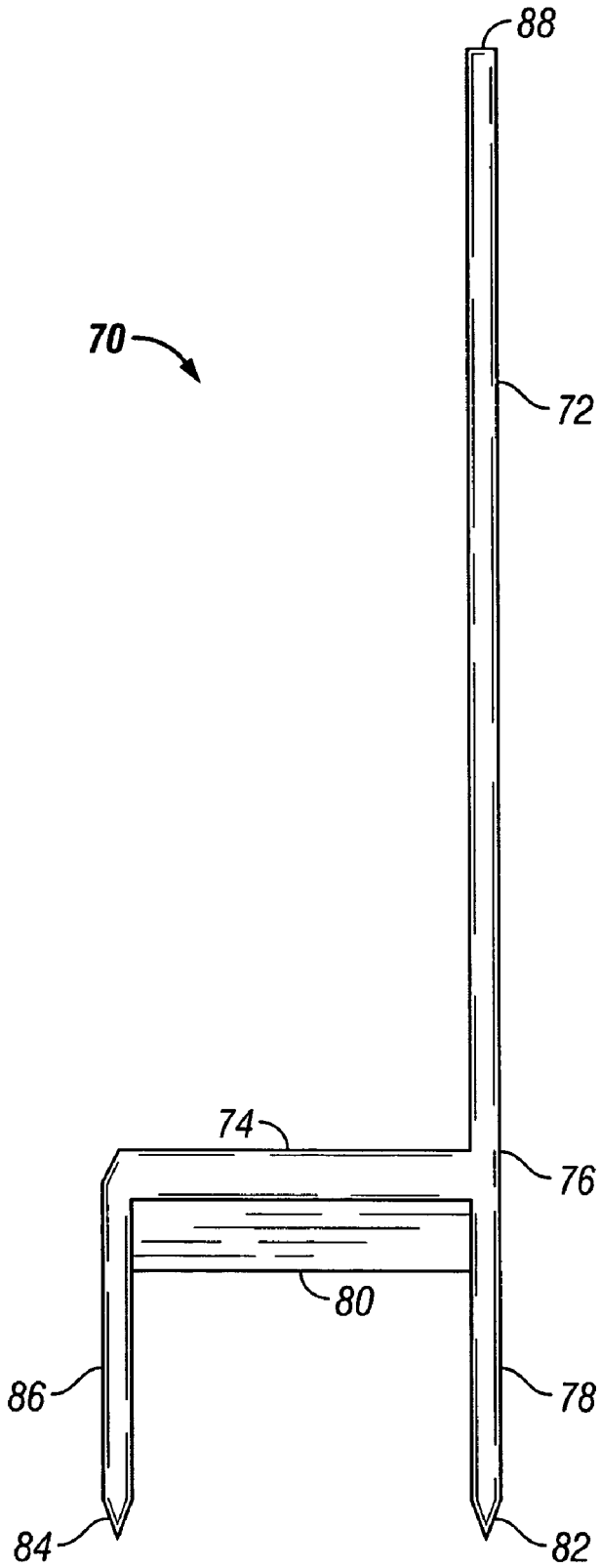
FIG. 5 is a side view of an embodiment of a back stop anchor base.

Referring to FIG. 5, in a most preferred embodiment of the present invention, the backstop anchor includes a support post 72, an installation bar 74, and stakes 78 and 86. Most preferably, the backstop anchor 70 is identical to the target anchor 10 with the exception that the backstop anchor 70 does not include the slight angle a from the vertical. This allows for additional simplicity in manufacturing of the system. Two backstop anchors 70 are utilized in the preferred embodiment of backstop 70.

Figure 6:
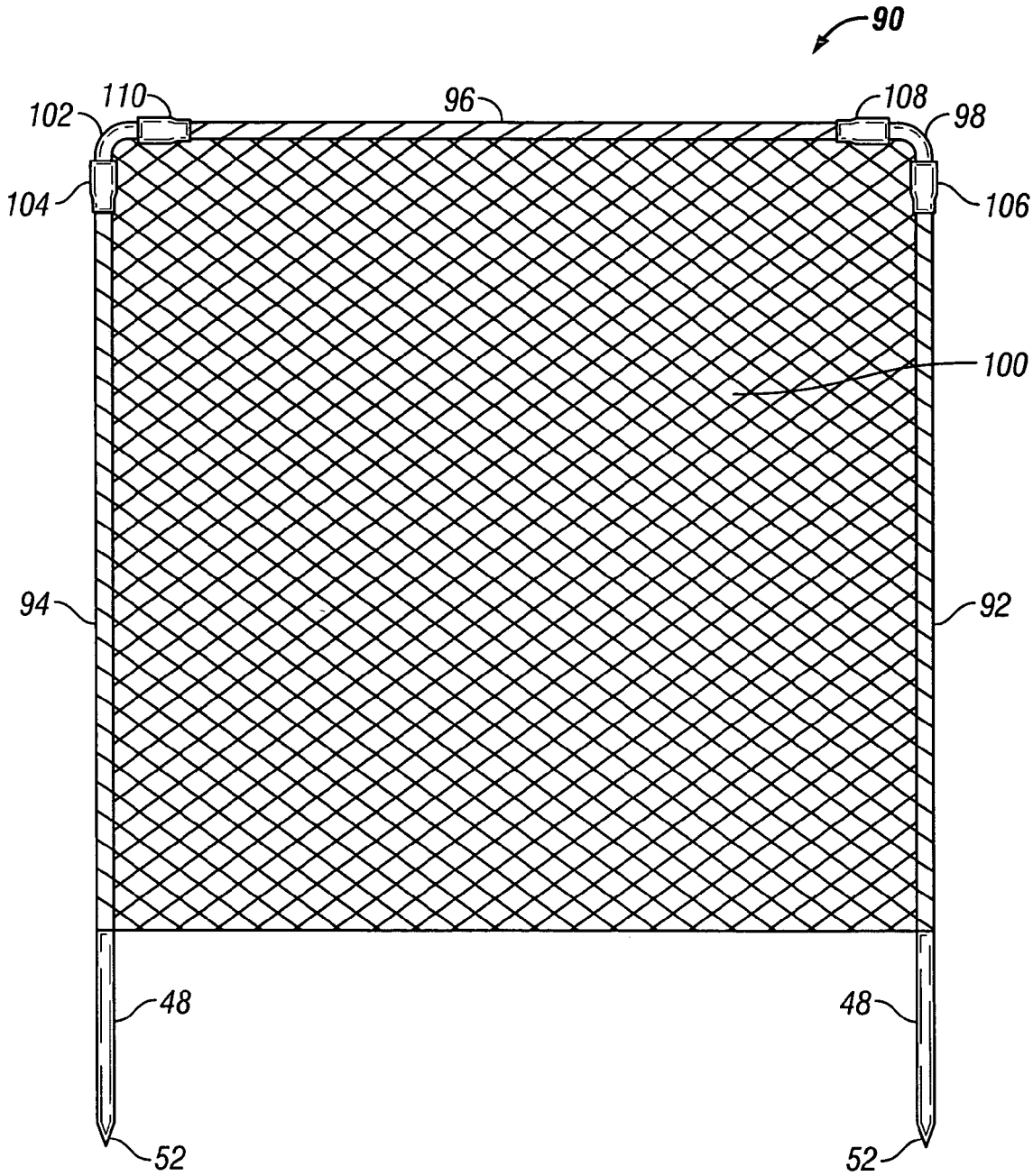
FIG. 6 is a front view of a back stop of an embodiment of the present invention.

Referring to FIG. 6, vertical net support members 92 and 94 are preferably tubing members. These can be thin-walled metal pipe, PVC pipe, or other similar types of tubing materials. Most preferably, vertical net support members 92 and 94 and elbows 98 and 102 are constructed from nominal three quarter inch rigid PVD schedule 40 n-metallic conduit. Vertical net support members 92 and 94 are preferably approximately six feet long. Elbows 98 and 102 (preferably 90° elbows) are attached to the upper ends 104 and 106 with support members 92 and 94. Vertical net support members 92 and 94 are placed over ends 88 of backstop anchor bases 70 and allowed to slide down to where they contact installation bar 74. Anchor 70 can then be placed in the ground at approximately six feet apart. Net 100 of suitable mesh and material such as would be known to those skilled in the art is then placed over vertical net support members 92 and 94.

A horizontal net support member 96 is also approximately six feet in length and made from the same tubing as the vertical net support members 92 and 94. Preferably, horizontal net support member 96 includes couplings 108 and 100 at opposite ends of member 96. Preferably, net support member 96 and couplings 108 and 110 are constructed from nominal three quarter inch rigid PVC schedule 40 n-metallic conduit. After installation of the upper portion of net 100 over horizontal member 96, elbows 98 and 102 are adapted to be received within couplings 108 and 100 of horizontal net support member 96. Preferably, vertical support member 96 is removably secured to vertical members 92 and 94.

Figure 7:
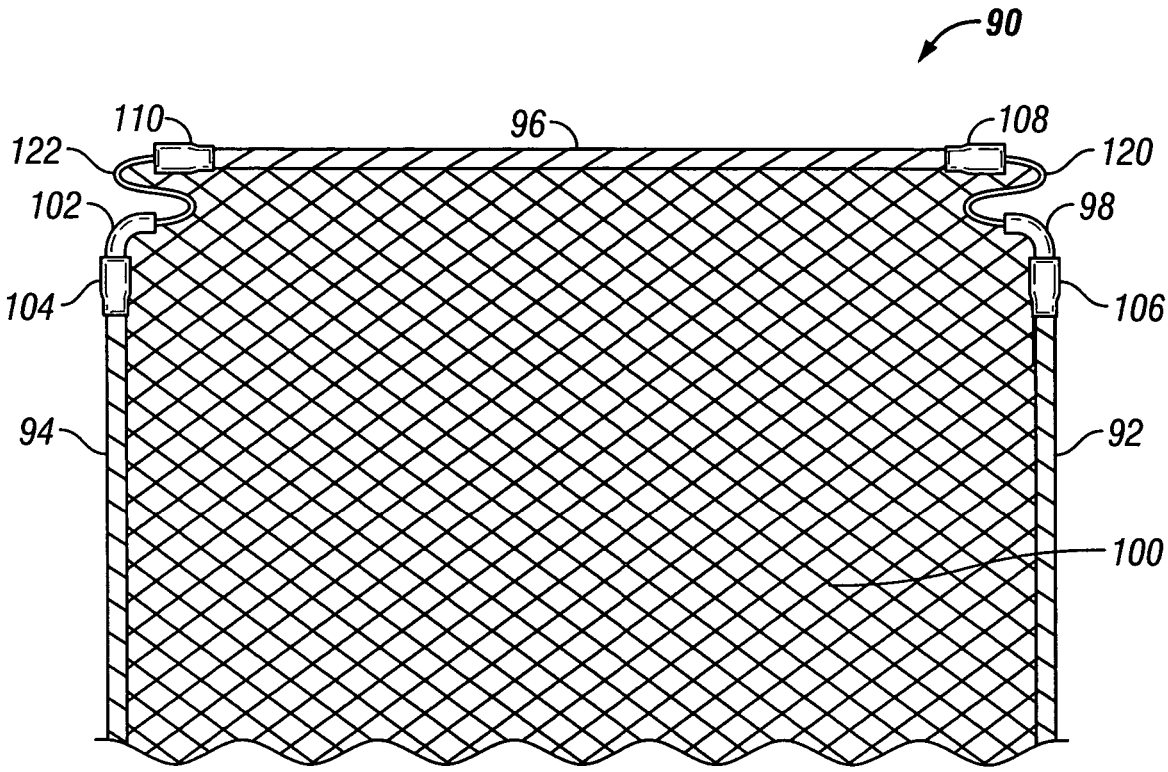
FIG. 7 is a partial front view of the back stop embodiment of FIG. 6 in an unassembled state.

Referring to FIG. 7, in a most preferred embodiment, support members 92, 94, and 96 are banded together by elastic bands 120 and 122. Preferably, elastic bands 120 and 122 are about 14" long and constructed from elastic bungee cord material. Preferably, elastic bands 120 and 122 are attached internally on one end to horizontal net support member 96 and on the other to vertical net support members 92 and 94, respectively.

In a most preferred embodiment, support members 92, 94, and 96 are banded together as follows. First, elastic band 120 is threaded through a nominal three eights inch flat washer (not shown). A knot is tied in elastic band 120 such that the knot cannot pass through the washer. The end portion of elastic band 120 opposite the washer is then inserted through a coupling 108. With the washer inside coupling 108, coupling 108 is rigidly affixed, such as by glue or pipe cement, to horizontal net support member 96. Next, the open end of elastic band 120 is inserted through elbow 98 and out the opposite side. The open end of elastic band 120 is then inserted through a nominal three eights inch second washer (not shown) and a second knot is formed such that the band 120 cannot be removed from the second washer. Elbow 98 is then rigidly affixed to vertical net support member 92 capturing the second washer inside. This process is repeated to a band net support member 94 to member 96. In this embodiment, back stop 90 can be disassembled for storage by twisting member 96 and removing it from elbows 98 and 102. Vertical members 92 and 94 can then be folded to be parallel with horizontal member 96 with the net 100 still attached. This allows backstop 90 to be conveniently rolled up and put away.

It is to be understood that the present invention is not limited to the embodiments described above, but encompasses any and all embodiments within the scope of the following claims.

We claim:

1. A target system, comprising:

a target anchor having an anchor base, and an anchor support post extending generally upwardly from said anchor base; and a target section comprising at least one target arm, said target section having a forward aspect and being rotatably secured to said anchor support post to be capable of at least partial rotation around said anchor support post; and a back stop for stopping balls that pass by said target section, said back stop comprising a pair of vertical net support members and a horizontal net support member, and a net, wherein said horizontal net support member is removably attached to said horizontal net support members.

wherein said anchor support post extends upwardly from the base at a slight angle toward a forward direction thereby allowing gravity to return the forward aspect of said target section toward its original position after rotation.

2. The system of claim 1, wherein said back stop further comprises attachment bands connecting each of the vertical net support members to opposite ends of said horizontal net support member such that when said horizontal net support member is detached from said vertical support members for disassembly, said net will remain secured within the confines of the three net support members.

3. A sport training target system, comprising:

a target anchor having an anchor base, and an anchor support post extending upwardly from said anchor base; and a target section comprising at least one target arm, said target section having a forward aspect and being rotatably secured to said anchor support post to be capable of at least partial rotation around said anchor support post; and a height adjustment collar positioned around said anchor support post for permitting said target section to be raised or lowered;

wherein said anchor support post extends upwardly from the base at a slight angle toward a forward direction thereby allowing gravity to return the forward aspect of said target section toward its original position after rotation.

4. The system of claim 3, further comprising a breakable target disk, removably attached to said target arm.

5. The system of claim 3, wherein said at least one target arm comprises an extension bar and a target plate.

6. The system of claim 3, wherein said target section comprises four target arms, each target arm comprising an extension bar and a target plate.

7. The system of claim 3, wherein said target section further comprises a securing sleeve for rotatably attaching said target section to said anchor support post.

8. The system of claim 7, wherein said securing sleeve includes at least one bearing.

9. The system of claim 3, wherein said target section further comprises a center hub from which said target arm extends.

10. The system of claim 3, wherein said height adjustment collar further comprises a securing bolt for securing said adjustment collar at a fixed position on said anchor support post.

11. The system of claim 10, wherein said securing bolt restricts rotation of said target section to about ninety degrees from the forward position.

12. The system of claim 3, wherein said anchor base comprises two stake portions and an installation bar, said installation bar being attached at an upper portion of each stake portions.

13. The system of claim 3, wherein said slight angle by which said anchor support post extends forward comprises between about 2 and about 10 degrees from vertical.

14. The system of claim 3, wherein said slight angle by which said anchor support post extends forward comprises between about 4 and about 6 degrees from vertical.

15. A system for training pitchers to throw balls accurately, comprising:

a target anchor having a base, and a support post extending upwardly from said base; and a target section comprising a center hub and at least one target arm extending from said center hub, said target section having a forward aspect for facing a pitcher and being rotatably secured to said anchor support post to be capable of at least partial rotation around said anchor support post upon being hit by a ball, said target arm comprising an extension bar affixed at one end to said center hub and a target plate affixed to a second end of said extension bar; and a height adjustment collar positioned around said anchor support post for permitting said target section to be raised or lowered;

wherein said anchor support post extends upwardly from the base at an angle of between about 2 and about 10 degrees toward a forward direction thereby allowing gravity to return the forward aspect of said target section toward the pitcher after rotation.

16. The system of claim 15, further comprising a breakable target disk, removably attached to said target arm.

17. The system of claim 15, comprising four target arms extending outwardly from said center up such that said target plates of said target arms approximate four corners of a batter's strike zone.

18. The system of claim 15, further comprising a back stop for stopping balls that pass by said target section, said back stop comprising a pair of vertical net support members and a horizontal net support member, and a net, wherein said horizontal net support member is removably attached to said horizontal net support members.

* * * * *